United States Patent [19]

Beschorner et al.

[11] 3,937,017

[45] Feb. 10, 1976

[54] EXTERNAL COMBUSTION HOT GAS ENGINE SYSTEM

[75] Inventors: Franz Beschorner, Neusass; Burkart Feurer; Hans Aupor, both of Augsburg, all of Germany

[73] Assignees: Maschinenfabrik Augsburg-Nurnberg Aktiengesellschaft, Augsburg; Firma Motoren-Werke Mannheim Aktiengesellschaft, Vormals Benz Abtielung Stationarer Motorenbau, Mannheim, both of Germany

[22] Filed: Aug. 5, 1974

[21] Appl. No.: 495,009

[30] Foreign Application Priority Data

Aug. 9, 1973 Germany ..... 2340269

[52] U.S. Cl. ..... 60/516; 60/659; 60/671

[51] Int. Cl.[2] ..... F01B 29/08

[58] Field of Search ..... 60/516, 659, 671

[56] References Cited

UNITED STATES PATENTS

| | | | |
|---|---|---|---|
| 2,820,348 | 1/1958 | Sauter | 60/659 |
| 2,933,885 | 4/1960 | Benedek et al. | 60/659 |
| 3,062,000 | 11/1962 | Percival | 60/659 X |

FOREIGN PATENTS OR APPLICATIONS

| | | | |
|---|---|---|---|
| 80,012 | 6/1919 | Switzerland | 60/659 |

*Primary Examiner*—Martin P. Schwadron
*Assistant Examiner*—H. Burks, Sr.
*Attorney, Agent, or Firm*—Flynn and Frishauf

[57] ABSTRACT

To simplify control, decrease start-up time and improve efficiency, a heat storage device is provided connected to receive hot combustion gases from a burner, the heat storage device preferably including a vessel which contains a substance changing in phase between solid and liquid, and being heated by the exhaust gases from the burner. A heat pipe is in heat transfer relation to the substance, extending in a predetermined direction, and ducts, pipes or conduits conducting the combustion gases from the burner extend in parallel to the heat pipe, through the substance, or surrounding a vessel containing the substance. Preferably a group of heat storage units are joined to common inlet and outlet manifolds connecting combustion gases, arranged such that the flow speed of combustion gases further downstream is higher than that further upstream, to equalize heat transfer and hence storage capability and storage times of the individual units.

24 Claims, 11 Drawing Figures

EXTERNAL COMBUSTION HOT GAS ENGINE SYSTEM

Cross reference to related patents and application:

U.S. Pat. Nos. 3,795,102, 3,795,112, 3,802,198, 3,820,331, 3,821,734.

U.S. Ser. No. 400,883, filed Sept. 26, 1973, now U.S. Pat. No. 3,863,451.

The present invention relates to an external combustion engine operated by hot gases, and more particularly to a hot gas engine with a heat storage device which can be applied to the actual engine operating medium.

It has previously been proposed (see German Disclosure Document DT-OS 2,149,868) to apply heat derived from an external combustion source, such as a burner, over heat pipes formed as thermal diodes, the heat pipes conducting the heat to a heat manifold or distributing device, from which heat energy is derived to heat a heat exchanger, and a heat storage device. The energy is applied to the heat exchanger over heat pipes formed as thermal triodes, that is, over heat pipes through which the heat energy being transferred is controllable. If too much heat is applied to the heat storage device, the temperature in the distributing chamber may collapse, so that insufficient heat is applied from the distributing chamber to the heat exchanger of the hot gas motor. In the system, as proposed, a heat pipe system applies heat from an external combustion apparatus, such as a burner, to the heat storage device. Transmitting energy in the form of heat over a heat pipe is subject to losses, however, due to heat passage through walls thereof, resulting in substantial temperature drop. Since the operating temperature of heat pipes of the diode type cannot exceed certain maximum temperatures due to limitation of materials, losses resulting in temperature drop cannot be overcome by increasing the output temperature (which would require an increase in input temperature). Heat storage devices include a medium which changes from solid to liquid phase, that is, which stores heat upon being heated. Before such a heat storage device can operate satisfactorily, upon having heat applied thereto from the heat pipe leading to the heat storage device, it is necessary to first bring the heat carrier medium by pure heat conduction to molten phase and to its operating temperature. A heat conduction medium is, for example, sodium which only begins to operate efficiently from a temperature of about 500° C; the sodium is contained within a high temperature heat pipe and, therefore, in the known arrangement charging of the heat storage device is slow and loading of heat energy into the heat storage device is gradual. Apparatus, as proposed, have the further disadvantage that the heat flow is usually radially outwardly directed from a centrally arranged heat pipe, when it is desired to charge or load the heat storage device. The surface effecting heat transfer or heat exchange from the heating pipe to the storage medium is therefore relatively small. The storage medium, in the known devices, progressively melts in a radially outward direction, starting from the centrally located heat pipe, so that, if a certain heat energy is applied, the radially inner regions or zones will have a comparatively high thickness of storage medium in melted, that is, liquid phase. This storage medium, when melted, has a substantially poorer heat conductivity than the crystallized, or solid heat storage medium, and this causes substantial temperature drop. Utilization of a heat pipe effect to charge or load the storage device requires substantial control equipment in order to prevent collapse of temperature in the distribution chamber since the various storage devices and heat conductivity devices can be switched only in a predetermined temporal sequence. The control equipment necessary to control the burner of the external combustion system, and to control the heat pipes formed as triodes is substantial. A certain redundancy is necessary in the control equipment for many operating conditions; this redundancy further increases the amount of equipment required for the control system. The heat exchanger will be subjected to temperature differences if the hot gas is operated under simultaneous loading of the heat storage device. To control temperature differences requires additional control equipment.

It is an object of the present invention to improve the reliability and efficiency of the heating and heat supply system for a hot gas engine, in which the requirements for control equipment are decreased, and in which charging or loading of heat storage devices is speeded while requiring only a minimum in control apparatus.

SUBJECT MATTER OF THE PRESENT INVENTION

An external combustion hot gas engine system has an engine heat exchanger, and a burner which provides hot combustion gases, and further heat supply means including a heat storage device, the heat supply means and the heat storage device deriving heat from the hot combustion gases, and supplying this heat to the heat exchanger.

In accordance with the present invention, the heat storage device is connected to receive the hot gases from the burner; preferably, the heat storage device includes a vessel retaining a substance which is subjected to cyclical changes in phase. The heat storage device includes a heat pipe extending into the heat storage device in a predetermined direction, and in heat exchange relation to the substance which changes phase, and a duct connected to receive the combustion gases from the burner, located in the heat exchange relation to the heat storage device and extending parallel to the heat pipe of the heat storage device so that heat energy can, selectively, successively or simultaneously be supplied from the burner and withdrawn through the heat pipe.

The invention will be described by way of example with reference to the accompanying drawings, wherein.

Figure 1:
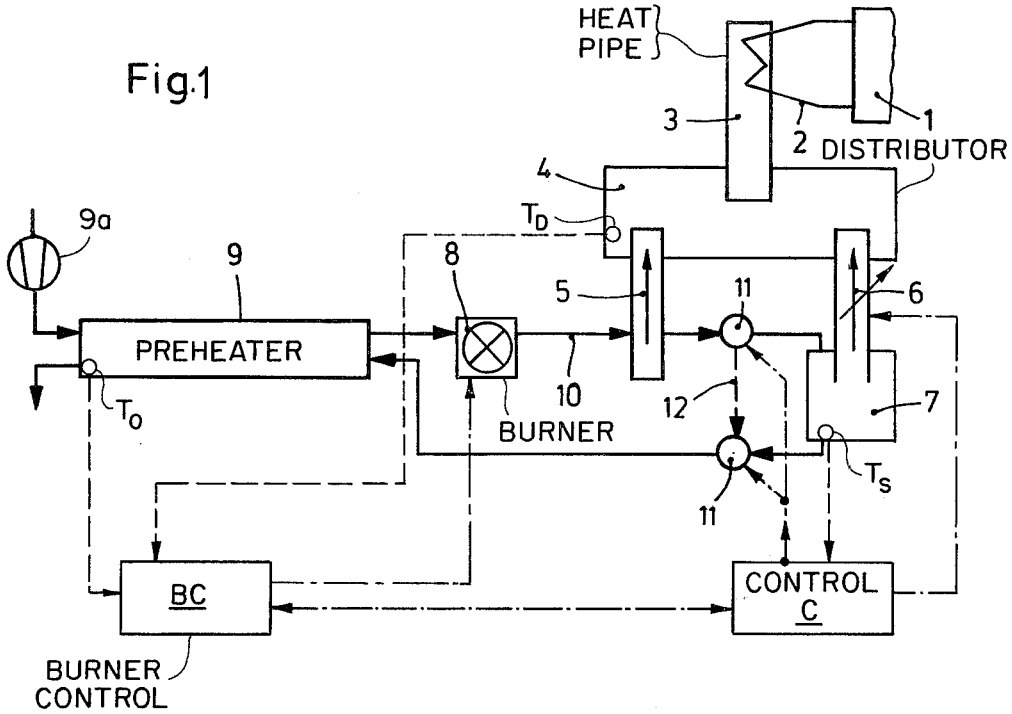
FIG. 1 is a general schematic block diagram of a system in accordance with the present invention with a simple external combustion burner system.

A hot gas engine 1, only schematically indicated (FIG. 1), has hot gases applied thereto through a heater 2, connected to a first heat pipe 3 which derives heat from a distributor 4. Heat from distributor 4 is applied by means of the heat pipe effect to the heater 2. The distributor 4, preferably a distributor tube, or manifold or the like, has heat supplied thereto by a second heat pipe 5, preferably a thermal diode, that is, a heat pipe which transmits heat only in the direction of the arrow in heat pipe 5. Heat pipe 5 has heat applied thereto by an external combustion system. Heat is additionally applied to the distributor 4 through a heat pipe 6, preferably formed as a thermal triode, and applying heat in the direction of the arrow as shown within heat pipe 6, but with controllable energy transfer. Heat pipe 6 is in heat transfer relationship to a heat storage device 7, and can be heated from the storage device 7. Heat is applied to the storage device 7 from an external combustion system.

Since heat is applied, in the example shown, to the distributor 4 over thermal diodes, and thermal triodes, the distributor 4 can be constructed as a simple, non-controlled heat pipe. Distributor 4 could, however, also be constructed as a controlled triode, for example by including a cold trap in connection therewith. Simple heat pipes can be used for the heat transfer pipes 5 and 6. A thermal diode is a heat pipe in which the heat is transported only in the direction for which it is designed, in the present direction to the distributor 4. A thermal triode is a heat pipe in which the heat energy being transported can be controlled, or completely interrupted. The heat storage material within the heat storage device 7 may, for example, be lithium fluoride which melts when the heat storage device has a heat charge applied thereto, that is, when it is being loaded. Upon solidification, the heat of liquification is liberated and can be taken off over the triode 6 when it is desired to discharge, or unload the heat storage deivce 7, that is, to apply the heat over triodes 6 through distributor 4 to the hot gas engine 1.

In its simplest form, the external combustion system includes a burner 8, for example, an oil burner, gas burner or the like which receives combustion air over a pre-heater 9, the combustion air being applied for example by a fan or blower 9*a*. The combustion gases are conducted from burner 8 through a line 10. Line 10 connects the combustion gases first to the diode 5 which, in actual structure, may be a group of unilaterally conducting heat pipes. Downstream - with respect to flow of the combustion gases - from diode 5, is the heat storage device 7, and the heat still in the combustion gases is sufficient to melt the heat storage material therein. The heat storage device 7 is directly heated by hot combustion gases and thus can be loaded rapidly. The remaining heat still available from the combustion gases is utilized by returning the combustion gases back to the pre-heater 9 to preheat the air for combustion in burner 8. Preferably, the air is pre-heated, with respect to the combustion gases, in a counterflow heat exchanger. The combustion gases, with practically all the heat content removed, are then exhausted.

The stream of combustion gases through the heat storage device 7 can be controlled by locating valves 11, 12 at the inlet and outlet to the heat storage device 7, the valves being connected together by means of a short circuit line 12. The valves 11, 12 may, for example, be flap valves of the three-way type. During loading of the heat storage device 7, short circuit or shunt line 12 is disconnected. After loading, the heat storage device 7 is bridged or shunted over line 12. The valves 11, 12 are controlled by a sensor $T_S$, sensing the outlet temperature from the heat storage device 7, which sensed temperature is applied to a control unit C which, in turn, provides the necessary positioning output signals to valves 11 to regulate the flow of the gases through shunt line 12. The input control lines are schematically indicated in the Figures in broken lines; the output control lines in chain-dotted lines.

Usually, the heat supplied by the external combustion system to the diodes 5 is sufficient in order to operate the hot gas engine 1. Peak loading may, however, require additional heat which is derived from the heat storage device 7. Heat is derived from the heat storage device 7 and applied through the triode heat pipe 6 to the distributor 4, by suitable control of the triode 6 from the control unit C. If necessary, cold traps may be used in the control system. The hot gas engine 1 can be operated also without the diodes 5, directly from the heat storage device 7. Let it be assumed that the burner 8 first has charged or loaded the heat storage device 7, and is then stopped, so that it will not cause exhaust gases. Heat can then be derived from storage device 7. This mode of operation may be used in an automotive vehicle with advantage; for example, in built-up areas, in start-stop operation, or the like, it is important that the emission of exhaust gases from the burner be avoided. On the open road, and in open high-speed operation, the burner can be started and by suitable switching of the triodes 6, the heat storage device 7 is again charged to supply heat when the burner is disconnected.

The burner 8 can be controlled to apply a constant output, that is, can be loaded to a constant fixed load position by measuring the air outlet temperature $T_O$ from the pre-heater 9. To sense change in loading, the temperature $T_D$ in the distributor pipe 4 provides a suitable command signal. The control system is simple and can be readily supervised, as is apparent from the diagram of FIG. 1. Heating of the diodes 5 and loading of the storage device 7 requires only a single burner, so that the entire arrangement uses a minimum of components. The output signal from the distributor 4 may also be applied through the burner control unit BC to the heat transfer control unit C to command the heat transfer triode pipe 6.

Figure 2:
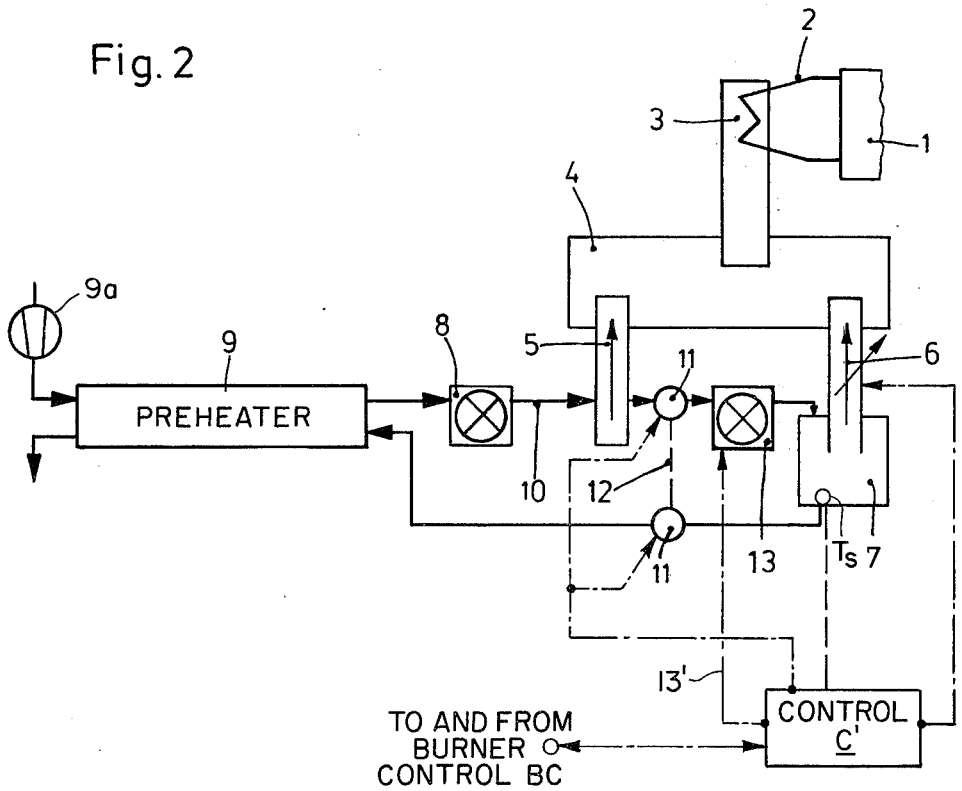
FIG. 2 is a schematic diagram of a system similar to FIG. 1 and having two burners.

In the embodiments to be described, similar elements operating similarly will not be described again and have been given the same reference numerals. The arrangement of FIG. 2 utilizes two burners. This increases the enthalpy of the combustion gases after heat has been delivered to the diodes 5, by providing a second burner 13, behind the diode 5, and located in series with the burner 8. Burner 13, in the simplest case, is driven at a constant output loading. In a preferred form, however, burner 13 is controlled from control unit C′, which will have an additional output, control being effected under command of the output signal derived from sensor $T_S$ of the output temperature of the storage device 7. After the storage device 7 has been charged with heat energy, burner 13 is disconnected. The combustion gases derived from burner 8 are conducted over the shunt line 12, controlled by the valves 11, and shunted away from burner 13 and storage device 7. The arrangement utilizing two burners provides for substantial flexibility in operation of the entire system, and for rapid charging time of the heat storage device 7. Burner 13 can be operated at constant loading, and is connected in series with the controllable burner 8; this embodiment provides for simple control of the entire system. Control of burner 13 is obtained over line 13′ from control unit C′. Control of burner 8 is identical to that of FIG. 1 and therefore the burner control unit BC has been omitted from FIG. 2.

Figure 3:
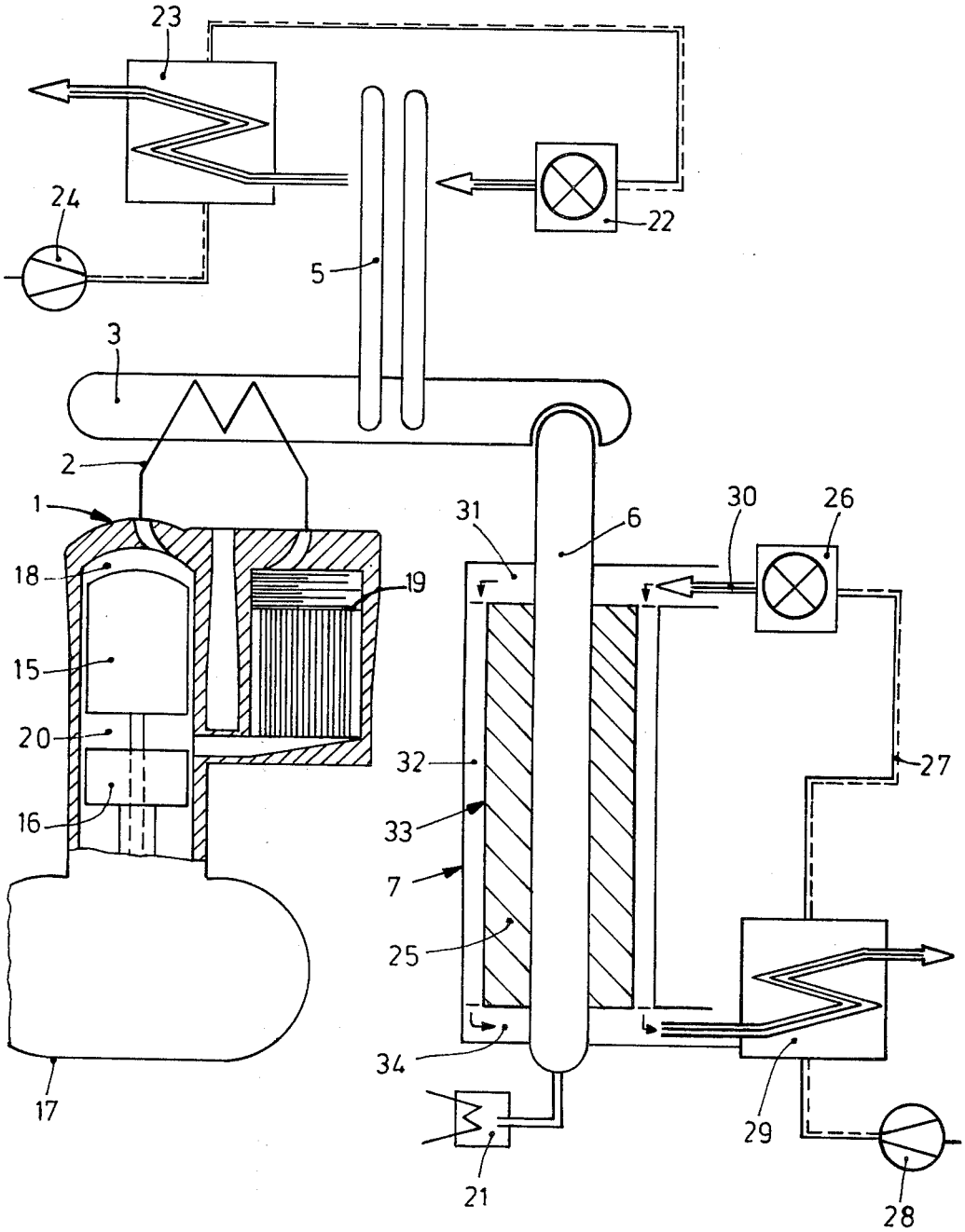
FIG. 3 is a fragmentary highly schematic cross section through those portions of the system which are not standard elements or components.

The system of FIG. 3 illustrates the hot gas engine in greater detail, in combination with the heat supply system. The hot gas engine 1 has a displacement piston 15 and an operating piston 16, the pistons being connected to gear drive in a gear box 17. The working gas for the hot gas engine 1 is, for example, helium. The flow path of the hot gas medium leads from the hot working space 18 over the heater 2 to the herein attached regenerator-cooler 19, and then to the cold working space 20. As the gases pass through the heater 2, the working medium, for example helium is heated, that is, has heat energy applied. The heat pipe 3 is used in this case to heat the heater 2. Heat pipe 3, for example, has heat applied thereto externally to vaporize sodium within heat pipe 3. The sodium vapor condenses on the heater 2, which is at relatively low temperature, and delivers heat energy thereto. The condensate which may arise is re-cycled to the surfaces which are externally heated over a capillary system. In the present example, the heat pipe 3 is heated directly from a group of heat pipes formed as thermal diodes 5, and by another group of heat pipes, one of which is shown, and forms a thermal triode 6. The heat pipes, formed as thermal diodes, have a capillary system therein which is so arranged that the capillary system is effective in only one direction. Thus, flow of the heat is possible only in one direction. Heat flows through the heat pipes formed as thermal triodes 6 can be interrupted by a cold trap 21, shown only schematically. If the temperature set at the cold trap 21 is less than that of the heat pipe 3, no more heat is transported towards the heat pipe. By the direct connection of the second heat pipe, that is, in the present case the thermal diodes 5, and by the connection of the heat pipes formed by the thermal triodes 6, directly with heat pipe 3, it is possible to reduce the losses which arise when heat energy is transferred through confining walls of the heat medium to a minimum.

The external combustion system consits of two completely independent sub-systems. Each sub-system has its own suction or fresh air supply blower or fan system, pre-heater, and it own burner. Two heat tubes 5 of the diode type are illustrates, representing a group of such heat pipes. A separate burner 22 is provided to heat the pipes 5, supplied by combustion air from a blower 24, which passes air through a pre-heater 23. The partly cooled combustion gases pre-heat the air in pre-heater 23 as indicated schematically in FIG. 3. Control of the burner 22 is effected similarly to the example of FIGS. 1 and 2, that is, by measuring, for example, the outlet temperature of the gases derived from the pre-heater 23 to obtain a constant load command signal, or to measure the temperature in the heater 3 to determine a variable load point, and to provide a variable command signal to burner control unit BC which, in turn, controls the burner 22 (omitted from FIG. 3, for clarity).

The heat storage device 7 is illustrated to include merely a single storage element 25, although a plurality would be used, as will appear. A burner 25 provides hot combustion gases to the storage unit 7. Air is supplied through an individual blower 28, pre-heated in a pre-heater 29 and conducted over inlet pipe 27 to the burner 26. The combustion gas outlet 30 from the burner is applied to a distributing manifold 31, located in the region of the axial end face of the storage unit 25. The manifold 31 distributes the combustion gases derived from burner 26 to ducts 32 of a plurality of storage units 25. The cross-sectional area of the ducts 32 is much less than that of the manifold 31, so that approximately equal distribution of the combustion gases to all the ducts will result automatically. The combustion gases are carried in axial direction at the radially outer wall 33 of the storage units 25 and they collected in a collection manifold 34 which is opposite inlet manifold 31 and which may be similar thereto. A combustion gas line similar to inlet line 30 is then connected to the pre-heater 29, pre-heater 29 operating as a heat exchanger, preferably in counterflow mode. Using two parallel separate systems to supply heat by external combustion, in which each burner has its own independent pre-heater, permits completely independent operation of the separate sub-systems, without any feedback. An additional advantage is the ease of location of the various gas and combustion gas lines, air lines, and the like which result in great flexibility of location of components.

Ordinarily, the hot gas engine 1 would be operated with burner 22. To prevent environmental air pollution, however, and in built-up areas, heat can be derived from the heat storage device 7. Control of delivery of heat is obtained by the cold traps 21. The heat storage device 7 could also be completely separated from the heater 3. As shown, a small gap is left between the triodes 6 and the heat pipe 3, so that heat has to pass from the triodes 6, deriving heat from storage device 7 through the gap to the heat pipe 3. A heat dissipation element can be introduced into the gap to conduct heat away from the gap, that is, to prevent or modify the transmission of heat from heat pipes 6 to heat pipe 3. Any heat shield, or heat conductor introduced into the gap between pipes 6 and heater pipe 3 may be used to additionally pre-heat, for example, the air applied to burner 22, so that the efficiency of the overall system is not decreased.

Figure 4:
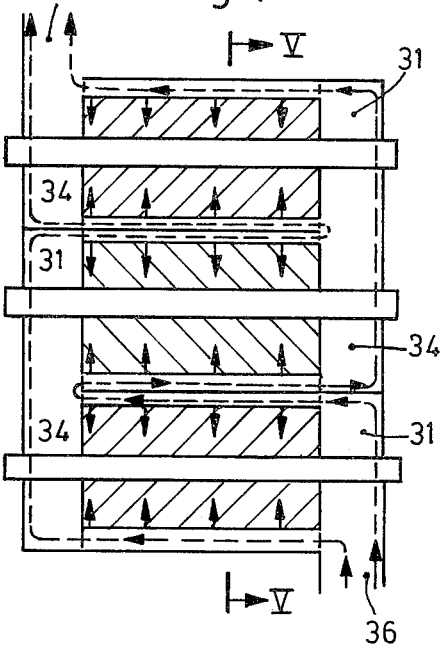
FIG. 4 is a schematic cross-sectional view of a heat storage device directly subjected to combustion gases.
Figure 5:
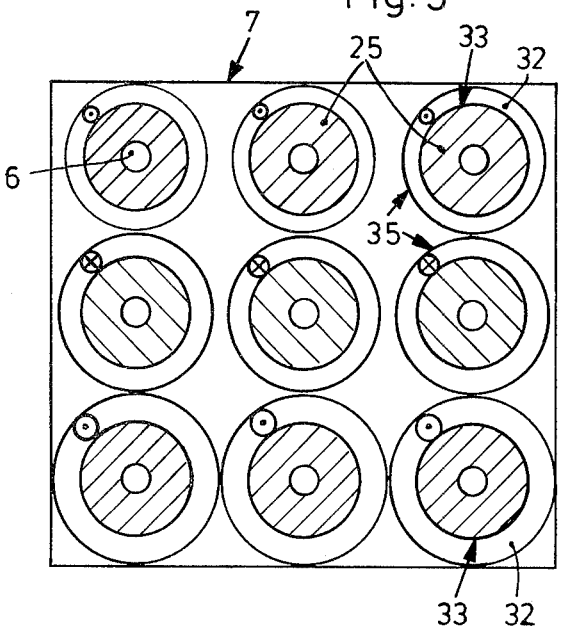
FIG. 5 is a cross-sectional view along line V—V of FIG. 4.

The heat storage device 7, shown only highly schematically in FIG. 3, is illustrated in greater detial in FIGS. 4 and 5. A plurality of storage units 25 are located in groups, assembled in rows of three units 25, each. This results in a compact spatial arrangement. The various rows are stacked in parallel layers to each other. Preferably, the storage units 25 are cylindrical, and have centrally arranged triode tubes 6. Each storage unit 25 is surrounded by a concentrically located outer sleeve or tube 35 which forms the duct 32 between the sleeve 35 and the radially outer wall 33 of the associated storage unit 25, by enclosing a cylindrical, annular space. Large heat transfer surfaces are obtained thereby. The heat flux, as is indicated by the arrows in FIG. 4, is radially inwardly directed to the triodes 6, upon loading, as well as upon unloading of the storage device. The liquid heat storage material is in the radially outwardly located regions; the solidified heat storage material is in the zones adjacent the triodes 6. The resistance to heat conductivity of the molten storage material is high with respect to that of the solidified heat storage material. The heat transfer conditions are therefore desirable, both for loading as well as for unloading. Upon loading, the thickness of the layer of the liquid storage material is small due to the large surface through which heat can pass. The triodes are unloaded through the solidified storage material, at a small diameter, that is, a smaller surface has to be traversed for heat flux, upon unloading of stored heat energy. It is an advantageous characteristic of the invention that heat flow occurs in only one direction; upon loading or charging the heat storage device, the worse heat conductivity characteristics of the liquid storage material are therefore compensated.

The combustion gases are simply and directly guided past the various storage units. The storage units are assembled in groups, alongside of which the combustion gases pass in parallel to the heat pipes 6. The groups are connected to common distribution manifolds 31, 34, respectively. By merely serially connecting the various groups of the storage units, combustion gases will pass therealong in the direction of the arrows, and as indicated by the broken lines in FIG. 4. Heat energy contained in the combustion gases is thus efficiently and effectively utilized, that is, practically all the energy contained therein is extracted. The temperature difference which arises in the combustion gases between the input 36 and the output 37 of the heat storage unit is very high. Due to the substantial temperature drop of the gases, however, the charging or loading time of the various storage increases from group to group. These storage or loading times can be equalized by increasing the speed of the gas flow of the later groups (that is, in the direction of gas flow, downstream from the inlet). As an example, the number of individual storage units 25 in any one of the groups can become less and less as the groups are connected in downstream direction. This has the advantage that all the storage units 25 can be constructed to be equal, although the speed of flow of the combustion gases increases. As illustrated in FIG. 5, however, this object can be obtained differently, by changing the diameter of the outer sleeve 35 to decrease from group to group, in downstream direction. This way of increasing the speed of flow of the gases as they become cooler has the additional advantage that each group will have an equal number of storage units 25 associated therewith. The essentially uniform charging or loading time then approximately corresponds to the duration which would be required to load any individual group with heat energy, when being supplied with combustion gases of average temperature, that is, average between inlet and outlet connection.

Figure 6:
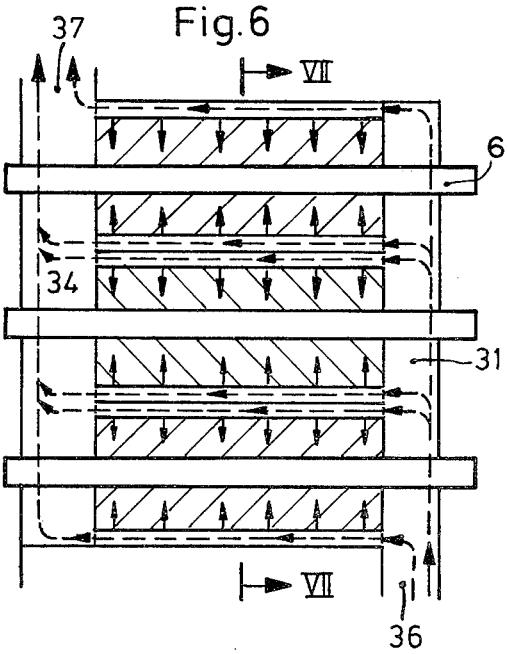
FIG. 6 is a longitudinal sectional view of another embodiment of a heat storage device assembly.
Figure 7:
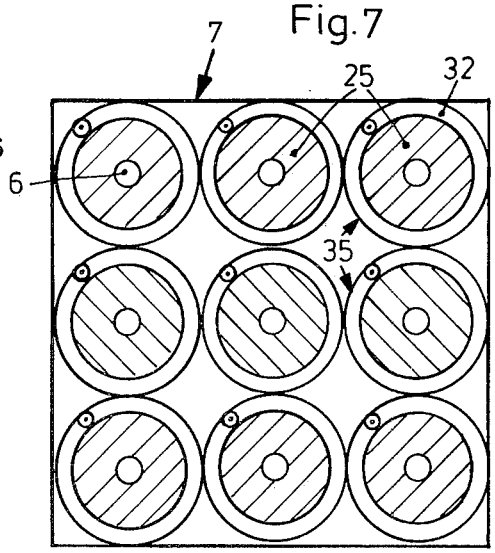
FIG. 7 is a cross-sectional view along line VII—VII of FIG. 6.

FIGS. 6 and 7 illustrate storage units 7' in which all the storage elements 25 are connected to form a single storage group, alongside of which all the gases pass in parallel. The ducts 32 defined by the outer sleeves or cylinders 35 around the storage units 25 are all connected to common inlet and outlet manifolds 31, 34. Since all the storage units 25 are equally and simultaneously exposed to the combustion gases, derived directly from the burner through the inlet manifold, the storage or charge time is very low. This arrangment has the additional advantage that all the storage unit may be identical, that is, all of them may have ducts 32 of the same size, since uniform flow of gases through the ducts is desired. A maximum number of storage units 25 can be located within a given space. The difference in combustion gas temperature between the input 36 and the output 37 of the arrangement of FIGS. 6 and 7 is less than that of the arrangment in FIGS. 4 and 5, however. This drop can be accepted if particularly short loading or charging time are important; further, the mechanical construction and arrangement of the storage units is simplified. This embodiment is particularly advantageous when the heat energy still contained in the combustion gases can be utilized to pre-heat the combustion air being applied to the burner units in the pre-heater elements 9 (FIGS. 1, 2) or 29 (FIG. 3).

Figure 8:
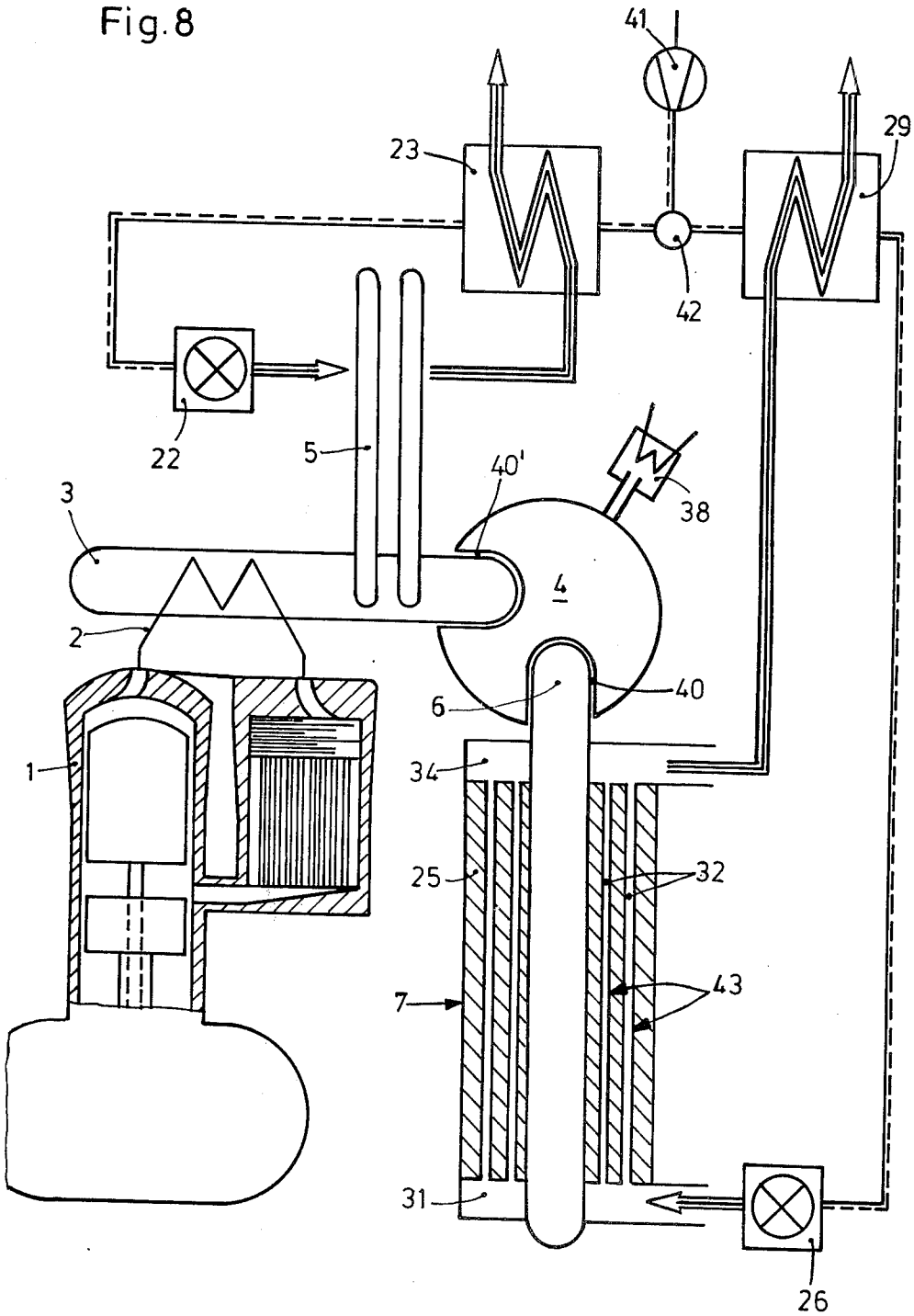
FIG. 8 is a simplified schematic diagram of another embodiment of the invention, similar to FIG. 3.

The heat storage device 7 preferably consists of a plurality of individual storage units 25. To simplify the arrangement of the storage units 25, the heat pipes 6 within the storage unit 25, as well as the geometry of the heater 2 and of the heat pipe 3 which supplies heat to the heater 2, it has been found desirable to provide a distributor pipe 4 between the heat pipes 6 and the heat pipe 3. Distributor pipe 4 - FIG. 8 - utilizes the heat pipe effect for heat transmission. Connection of the heat storage device 7 is simply obtained by constructing the distributing pipe 4 with a cold trap 38, that is, in the form of a controllable triode. Further apparatus to control the heat transfer from the heat pipes 6 in the heat storage devices 25 may then be omitted, and the control of the cold trap 38 can be connected similarly to the output from control unit C, FIG. 1 (or C', FIG. 2, respectively) to the heat pipes 6. The heat pipes 6 then can be constructed as simple, uncontrolled heat pipes, which further simplifies the control system, and the arrangement of the controls required. The heat storage device 7 can be completely isolated from the heat pipe 3 by providing a gap 40 between the heat pipe 6 and distributor 4, as well as another gap 40' between the distributor heat pipe 4 and heat pipe 3. An adjustable heat shield, or heat dissipating conductor can be introduced in the gap 40, manually or by a controllable positioning device. To improve heat transfer and to simultaneously control the heat transfer, the gap can be filled, more or less, with a material which has a high heat conductivity. In the example given, the second heat pipe group formed by the diodes 5 is connected outside of the distributor tube 4 directly to the heater 3. This reduces the number of walls through which the heat energy must be transferred when the hot gas engine 1 is supplied with heat from burner 22 which directly heats the diode-type heat pipes 5. If a large number of diode-type heat pipes 5 is provided, it may be desirable to also connect diodes 5 to the distribution tube 4. It is also possible to substitute ordinary heat pipes for the heat pipes 5, which have diode effect. Such heat pipes do, however, provide some heat by radiation to ambient atmosphere, to that a certain amount of heat will be lost when heat is supplied from the storage device 7, that is, when the burner 22 is disconnected.

The combustion gas which provides heat energy to the diodes, or heat pipes 5, that is, after having been burned in burner 22, is then used to pre-heat the air for the burner in the pre-heater 23. Thus, all heat which is generated is utilized. Burner 26 with its associated pre-heater 29 is arranged in parallel to the external combustion system to heat diodes 5. Burner 26 provides heat energy to storage unit 7. A common inlet blower system 41 is provided to supply combustion air to the pre-heaters 23, 29, connected in parallel. A suitable air flow distributor 42 distributes the mass flow of combustion air, in a desired proportion. Supplying heat to the diodes 5 requires a comparatively small mass flow; to charge the heater storage device 7, a greater mass flow is required. Connecting burners and pre-heaters in parallel permits suitable spatial arrangement of the repsective sub-systems and matching of the performance of the respective sub-systems to any desired mass flow of air. Of course, a common single pre-heater may also be used. If the storage burner 26 is disconnected, that is, if the overall mass flow of air is decreased by that required to operate the burner 26 to heat the storage device, combustion air for burner 22 will be heated to a greater degree, which increases the efficiency of the burner 22 itself.

Figure 9:
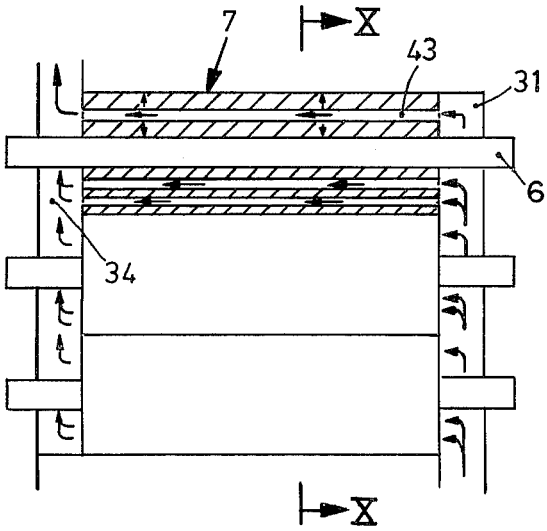
FIG. 9 is a fragmentary sectional view through a heat storage device, in horizontal position.
Figure 10:
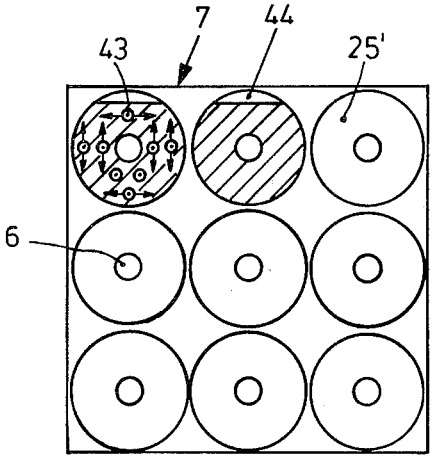
FIG. 10 is a cross-sectional view along line X—X of FIG. 9.

The combustion gas distribution manifold 31, for inlet air, and the outlet manifold 34 are connected to tubes 43 corresponding to the connection ducts 32 (FIG. 3), the tubes 43 being located within the storage material of the associated storage units. The heat transfer surface which is thereby obtained, formed of the sum of the transfer surfaces of the individual tubes 43 becomes high. This arrangement has the advantage that the various tubes 43 can be distributed over the cross section of the associated storage unit 25 in accordance with the mass distribution of the storage material in the storage units 25. This advantage is particularly apparent when the storage units are located in horizontal position, that is, rotated 90° with respect to the illustration in FIG. 8. The storage material, when solidified, is in crystalline state and has a lower volume than when in liquid state. When solidified, the storage units 25 are therefore not completely filled with storage material. FIGS. 9 and 10 illustrate a horizontal heat storage unit, for simplicity merely two storage units 25' are shown in detail in FIG. 10. As is clearly apparent from FIG. 10, solid storage material is not uniformly distributed throughout the cross section of the storage element 25 itself, but rather leaves a hollow empty space 44 in the upper region thereof. To prevent excessive heating of the storage unit in the region of the hollow space 44, pipes 43 forming the ducts 32 are distributed non-uniformly over the cross section of the storage unit 25, as is clearly apparent from FIG. 10. In the lower half, where a higher heat transfer is desired, a larger number of tubes 43 are provided - as clearly seen in the left-hand element of FIG. 10.

To obtain short storage or loading times, the various units 25' of the storing device, generally indicated at 7, are connected in parallel with respect to combustion gas flow, that is, are connected in parallel to a common input manifold 31 and to a common output manifold 34, respectively. Of course, sequential or serial connection of the various layers could be used; to render the storage time uniform, and to decrease the storage time, the cross-sectional areas of the flow ducts 43 can be made different (smaller at the downstream layers) or lesser numbers of tubes can be connected to have gases flow therethrough.

Figure 11:
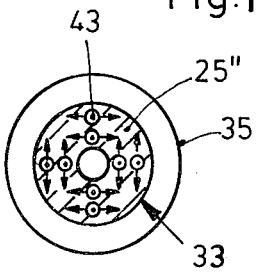
FIG. 11 is a fragmentary sectional view transverse to the axis of a heat storage unit, and illustrating another embodiment.

In vertically arranged storage units, as seen in FIG. 11, storage units 25'' are enclosed by a radially outer tube 35, which defines a cylindrical space between the inner wall thereof and the outer wall 33 of the storage unit 25'' itself, similar to the storage units of FIGS. 3 to 7. In the example of FIG. 11, tubes 43 are symmetrically distributed across the cross section of the storage unit 25''. Excessive heating of the zone of the storage unit 25 which is not filled with storage material if the material has solidified can be avoided by applying the hot gases to the lower region of the storage unit 25, in which storage material will always be present. When the combustion gases have risen to the upper regions of the storage unit, they have already cooled to such an extent that the various constructional elements and tubes through which they pass will no longer be damaged by excessive temperatures. This arrangement combines the advantages of storage units having an outer duct, and assemblies or arrays or bundles of hot gas ducts.

In accordance with the invention, therefore, the heat storage device is connected to the combustion gas outlets from an external burner system; in each one of the heat storage devices at least one duct, gas pipe, or the like, is provided, located in parallel to the flow direction of the associated heat pipe of the storage device. This arrangement permits high operating temperatures of the heat storage device, so that the system can operate with a large temperature difference, which increases efficiency. By suitable arrangement of the gas ducts, large heat transfer surfaces can be obtained.

Direct application of the heated exhaust gases to the heat storage devices permits immediate storage of heat energy upon application of exhaust gases, without delay. Due to the direct application of heat energy to the storage device, the storage device itself cannot remove heat from the associated heater to which it is to supply heat. It is therefore possible to operate the hot gas engine in its ordinary operating mode without further control systems for the heat flow. Heat transport through the heat pipes from the storage devices will be in only one direction; the storage of heat energy is thus entirely independent of operation of the associated hot gas motor, and control apparatus and control systems to match heat storage operation to the motor operation are therefore not required. Separating the heat supply to the motor and to the storage device permits operating the storage device, as well as the heater for the motor at substantially uniform operating temperatures. Controlled conduction of the combustion gases in the region of the heat storage units, or elements, of the heat storage device permits effectively uniform application of heat energy thereto and thereby efficient and essentially complete utilization of the heat energy available, as well as of the storage material which is available, decreasing the charge or loading time of the heat storage device and increasing efficiency of operation of the entire system.

Arranging the heat storage units or elements in layers and in rows provides for a compact, easily supervised arrangement, in which individual units can readily be replaced, or exchanged for maintenance or repair. Constructing the storage units in cylindrical form permits the location of heat transfer surfaces at equal distances from the center so that the various storage devices are uniformly heated, or cooled, respectively. Locating the storage devices in prismatic form permits, on the other hand, complete space utilization without any dead spaces. Combining a plurality of storage units, or elements in groups, equalizes the charge or loading time of the elements within the groups and permits connecting the various groups in series, or in parallel - with respect to flow of the combustion gases - as desired for best utilization of the combustion gases in given circumstances.

If a group of heat storage units is connected in parallel, then the flow speed of the combustioon gases - in direction of flow thereof - is preferably increased from group to group. The flow within the storage units themselves is turbulent. By increasing the flow speed, the heat transfer coefficient is improved. By considering the drop of the temperature difference of the farther downstream units, and correspondingly increasing the speed of flow permits averaging of the heat transfer, and thus averaging the loading or charging time of the various groups and, consequently, decreasing the overall loading time required to charge the entire heat store. The flow speed can be increased, for example, by decreasing the cross-sectional area of the size of the ducts for the combustion gases, decreasing the number of ducts, decreasing the number of units, or the like, depending upon whether it is of greater importance that all elements are uniform, that inlet and outlet manifolds are of utmost simplicity, or maximum space utilization. Any one or more of the constructional arrangements to increase speed of flow of the gases through the storage units which are farther downstream may be used.

Connecting all storage units in parallel substantially simplifies the manifolds to be constructed, and additionally decreases the required storage time; the flow speed of the exhaust gases then need not be specially controlled. The resulting heat storage device is simple, compact, and has high storage capability. A high temperature difference between the exhaust gases initially applied to the storage device, and the storage materials within the storage device itself will result. Use of the heat energy is, therefore, efficient and the loading time is short.

Constructing the various storage units in essentially cylindrical form, surrounded by an outer sleeve or outer covering tube through which the combustion gases pass, results in heat flux which is radially directed from the outside towards the inside of the storage units. Low resistance to heat flow in the zone adjacent the separating wall will result. Constructing the storage units with individually distributed tubes (FIGS. 9–11) permits high loading capacity and thin layers of charge or loading material surrounding the tubes, and thus provides for excellent heat transfer. The outer surrounding sleeves or duct tubes may be omitted entirely, if desired, thus permitting the storage units to be located in horizontal position (FIGS. 9, 10) with suitable re-location of the tubes, to provide for most efficient heat transfer to the heat storage substance. The distribution of the individual heat transfer tube will then be in accordance with the mass distribution of the heat storage substance within the heat storage units when the substance is solidified, for example has crystallized.

Providing two burners is a preferred embodiment of the invention, one burner providing heat to the engine directly and the other burner providing heat to the heat storage device. Providing two individually controlled heat sources substantially increases the flexibility of use and operation of the overall system and also substantially decreases the loading or charging time of the heat storage unit. To increase the combustion efficiency, at least one pre-heater to pre-heat the combustion air being applied to the burner is preferably provided.

Providing a distribution pipe, such as pipe 4, very slightly decreases the overall efficiency since heat transfer through an additional wall cannot be avoided. On the other hand, however, providing such a unit (FIGS. 1, 2, 8) substantially increases the freedom of layout and design for the designer of the entire external combustion motor system. The distributor 4 can readily be constructed in the form of a thermal triode with a heat trap (or, rather, a cold trap), thus permitting ease of control of heat flow from the heat storage device to the distributor and hence to the motor. Control may, in this embodiment, be left entirely to controlling the heat flow to the distributor tube 4, and separate controls for the storage unit heat pipes themselves may be eliminated.

Various changes and modifications may be made within the scope of the inventive concept.

We claim:

1. External combustion hot gas engine system having a hot gas engine (1), an engine heat exchanger (2), burner means (8, 13, 22, 26) providing hot combustion gases, and heat supply and distribution means (3, 4, 5, 6), including heat storage means (7) deriving heat from said hot combustion gases and supplying heat to the engine heat exchanger (2), the improvement wherein the heat storage device (7) is connected to receive hot combustion gases from the burner (8) and includes a heat storage substance, a heat pipe (6) extending into the heat storage device in a predetermined direction and in heat exchange relation with the substance, and duct means (32, 43) separate from said heat pipe (6), connected to receive the hot combustion gases from the burner, located in heat exchange relation to the heat storage substance and extending parallel to the heat pipe (6) to permit sequential or simultaneous withdrawal of heat energy by the heat pipe (6) and recharging of the storage device by energy from the burner.

2. System according to claim 1, wherein the heat storage device includes a vessel (25) retaining the substance which is subjected to cyclical changes in phase, the heat pipe (6) being in heat exchange relation with said substance.

3. System according to claim 1, wherein the heat storage device (7) comprises a plurality of heat storage units (25) arranged in layers, with individual units arranged in a row, each unit having said duct means, the heat storage units being located relative to each other such that the duct means (32) through which the hot gases pass along the heat storage units are in parallel paths.

4. System according to claim 3, wherein the speed of flow of the combustion gases through the duct means increases in the direction of flow and as the gases are cooled by heat exchange with the storage units.

5. System according to claim 4, wherein the plurality of heat storage units (25) is arranged in groups, and the number of heat exchange units (25) in any group having their duct means (32) connected in parallel to the hot combustion gases decreases in the direction of gas flow.

6. System according to claim 4, wherein (FIGS. 3, 4) the plurality of heat storage units (25) are arranged in groups, and the cross sections of the duct means (32) of different heat storage groups are of different cross-sectional area, in decreasing dimension in the direction of flow and as the ducts are more remote from the burner.

7. System according to claim 3, wherein (FIGS. 6, 7) the plurality of heat storage units have a common inlet forming an inlet manifold (31) and common outlets forming an outlet manifold (34), the manifolds being connected to the burner and to an exhaust, respectively.

8. System according to claim 3, wherein (FIGS 4, 5) the plurality of heat storage units (25) are arranged in groups, and wherein the groups of the heat storage units, each, have a common inlet, forming a group inlet manifold, and a common outlet, forming a group outlet manifold, the group inlet manifolds and the group outlet manifolds being connected to the burner means and to an exhaust, respectively.

9. System according to claim 1, wherein (FIGS. 3–7) the heat storage device (7) comprises at least one heat storage means forming a closed vessel (25) surrounded by a spaced tube or shield (35), the space between the vessel and the tube or shield forming said duct means (32).

10. System according to claim 1, wherein (FIGS. 9–11) the heat storage means (7) comprises a closed vessel (25') and a plurality of pipe, or conduit means (43) passing within said closed vessel, and forming said duct means, the combustion gases, at least in part, being conducted through said pipe or conduit means.

11. System according to claim 10, wherein the closed vessel retains a heat storage substance; and the heat supply to any one heat storage unit is distributed in dependence on the mass distribution of the heat storage substance within the closed vessel.

12. System according to claim 11, wherein the distribution of the pipes or conduits (43) within the closed vessel is arranged, across the cross section of the closed vessel, in dependence on relative mass distribution within the closed vessel of said heat storage substance, regions of greater mass of heat storage substance having a greater concentration of pipes, or conduits, per unit area.

13. System according to claim 1, wherein the burner means comprises at least two burners (8, 13, 22, 26);

the heat supply means comprises a direct heat pipe (5) having heated combustion gases from one of the burners (8, 22) applied thereto and supplying heat to the heat exchanger (2), the heat storage device (7) having heat applied thereto by the hot combustion gases from the other one of the burners (13, 28).

14. System according to claim 13, including at least one pre-heater (9, 23, 29), receiving heat from exhaust combustion gases from at least one of the burners to pre-heat combustion air being supplied to the burners.

15. System according to claim 14, wherein said one burner (8) having said direct heat pipe (5) associated therewith is located in advance - with respect to flow direction of combustion gases - of the other burner (13) providing heat to the heat storage device (7).

16. System according to claim 14, wherein both burners (8, 13) are connected in parallel with respect to pre-heated combustion air.

17. System according to claim 13, wherein each one of the burners (22, 26) has an individual pre-heater (23, 29), the pre-heater having combustion gases from the associated burner applied thereto to pre-heat air being supplied to the respective burner.

18. System according to claim 1, wherein the heat supply means comprises a heat distributor (4) connected in heat exchange relation to the heat exchanger (2) to deliver heat thereto and being further connected in heat exchange relation to the heat storage device (7) to receive heat therefrom.

19. System according to claim 18, wherein the heat supply means further comprises a direct heat pipe (5) having heated combustion gases from said burner means (8, 13, 22, 26) applied thereto and supplying heat to the distributor (4) additionally, or exclusively of heat being supplied by the heat storage device.

20. System according to claim 19, wherein at least one of:

heat distributor (4);

heat pipe (6);

comprises a thermal triode in which the flow of heat transfer is controllable.

21. External combustion hot gas engine system having a hot gas engine (1), an engine heat exchanger (2), burner means (8, 13, 22, 26) providing hot combustion gases, heat storage means (7), heat supply and distribution means (3, 4, 5, 6), and heat conduction means (10, 30, 31, 34) to supply heat to the heat storage means, wherein said heat supply and distribution means to transport heat to the engine heat exchanger comprises a heat pipe system (3, 4, 5, 6);

said heat pipe system includes first heat pipes (5) exposed to combustion gases from the burner (8, 22);

second heat pipes (6) in heat exchange relation with said storage means (7);

and third heat pipes (3, 4) in heat exchange relation with at least one of said first and second heat pipes, (5, 6) and conducting heat to the engine heat exchanger (2);

the heat storage means (7) comprises a plurality of storage units (25), each being symetrical with respect to a center line thereof, said heat storage units (25) being located in adjacent rows and in superimposed layers, said second heat pipes (6) extending into said units centrally thereof, said units having duct means (32, 43) connected to receive the hot combustion gases from the burner and located in heat exchange relation to the storage medium of the heat storage device, and extending parallel to said heat pipe (6) centrally of the respective unit;

and collection manifolds (31, 34) to which said duct means (32, 43) are connected, located at the end surface of the respective storage units (25).

22. A heat storage battery (7) for combination with external combustion hot gas engine systems comprising a plurality of heat storage units (25) located in adjacent rows and in superimposed layers, each said units including a heat pipe (6) extending centrally of the units;

a heat storage medium surrounding said centrally located heat pipe;

duct means (32, 43) connected to receive hot fluids in heat exchange relation to said heat storage medium, said duct means extending parallel to the heat pipe centrally of the unit;

and distribution and collection manifolds (31, 34) to which said duct means (32, 43) are connected, located at the end surface of the respective storage units whereby hot fluids passing through the duct means will transfer heat radially inwardly to be stored in the heat storage medium, for removal by the heat pipe, as desired, simultaneously, or successively with application of heat to the storage medium by the hot fluids, and independently of flow of the hot fluids through said duct means to store heat in the storage medium.

23. Heat storage battery according to claim 22, wherein the plurality of heat storage units (25) are arranged in groups, and the cross sections of the duct means of the different heat storage groups are of different cross sectional area, in decreasing dimension in the direction of flow of the heat supplying fluid, and as the ducts are more remote from the source of said fluid.

24. Heat storage battery according to claim 22, wherein the closed vessel (25) is provided, said duct, or conduit means comprises a plurality of pipes or conduits (43) passing within said closed vessel, and the distribution of the pipes or conduits (43) within the closed vessel is arranged, across the cross section of the closed vessel, in dependence on relative mass distribution within the closed vessel of the heat storage substance, regions of greater mass of heat storage substance having a greater concentration of pipes, or conduits per unit area.

* * * * *